US007487626B2

(12) United States Patent
Van Deren

(10) Patent No.: US 7,487,626 B2
(45) Date of Patent: Feb. 10, 2009

(54) PONY BAR

(76) Inventor: Jennifer Suzanne Van Deren, 1120 Fitzgerald Ave., Gilroy, CA (US) 95020

( * ) Notice: Subject to any disclaimer, the term of this patent is extended or adjusted under 35 U.S.C. 154(b) by 84 days.

(21) Appl. No.: 11/384,934

(22) Filed: Mar. 21, 2006

(65) Prior Publication Data

US 2007/0220841 A1 Sep. 27, 2007

(51) Int. Cl.
*B68C 1/02* (2006.01)

(52) U.S. Cl. ..... 54/44.1; D30/135

(58) Field of Classification Search ..... 54/44.1, 54/44.2, 71; D30/134, 135, 138
See application file for complete search history.

(56) References Cited

U.S. PATENT DOCUMENTS 2,581,714 A * 1/1952 Rovere ..... 54/44.1
5,101,614 A * 4/1992 Bozanich ..... 54/44.1
5,372,348 A * 12/1994 Cheng ..... 248/447.2
5,651,240 A * 7/1997 Tompkins ..... 54/44.1
6,062,006 A * 5/2000 Jones ..... 54/44.7
7,021,037 B1 * 4/2006 Szymas ..... 54/44.1

* cited by examiner

*Primary Examiner*—Rob Swiatek

(57) ABSTRACT

The Pony Bar is a handle bar that attaches to the horn of a western horse saddle. The purpose of the handle bar is to provide a safety mechanism for kids to hold on to while sitting in the saddle and riding. The components of the handle bar are comprised of various materials including a metal pipe, connecting bolt, bolt fasteners and hand grip material. The bar helps a rider stabilize him/herself and therefore helps to prevent falls and encourage confidence and balance while in the saddle.

3 Claims, 4 Drawing Sheets

PONY BAR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC. OR REFERENCE TO A "MICROFICHE APPENDIX"

Not Applicable

BACKGROUND OF THE INVENTION

1. The Problem

Kids learning to ride ponies and horses do not have a part of the saddle to easily hold on to. As seen in FIG. 4, the English style saddle (26) has no horn. In FIG. 3, the Western style saddle (24) has a horn (12) but it is vertical and not well-shaped for a hand-hold to support the rider should the horse move suddenly or unexpectedly such as when a horse spooks, trips, shakes, turns or trots. Prior to The Pony Bar, there was no simple device available to provide the beginner rider with an ergonomic handle bar to effectively steady themselves on a ride and at the same time require no alteration, modification or damage to any of the existing standard saddle structures.

2. The Idea

Design a device for kids to easily hold on to so they are less likely to fall off during a pony or horse ride. English saddles have no place to hold on and western saddles have a horn, but it is not at all easy for kids to grip. The Pony Bar allows riders a stable, ergonomic handle to help prevent falls which in turn encourages confidence and balance for the young or beginner rider while participating in pleasure riding, training and/or therapeutic riding.

BRIEF SUMMARY OF THE INVENTION

As seen in FIG. 1, The Pony Bar (10) is a handle bar that attaches to the horn of a standard, non-adaptive western style horse saddle with no need for modification to the existing horn (12), pommel (16), seat (14) or any part of the saddle structure. The purpose of the handle bar is to provide a safety mechanism for kids to hold on to while sitting in the saddle and learning how to ride. The components of the handle bar shown in FIG. 2 are comprised of various materials including a horizontal pipe (20), a curved connecting bolt (22), bolt fasteners (18) and hand grip material. The bar helps a rider stabilize him/herself with a secure horizontal hold and therefore helps to prevent falls and encourage confidence and balance while in the saddle.

BRIEF DESCRIPTION OF THE VIEWS OF THE DRAWING(S)

Included in this application is a drawing entitled FIG. 1, FIG. 2 and FIG. 3.

DETAILED DESCRIPTION OF THE INVENTION

Figure 1:
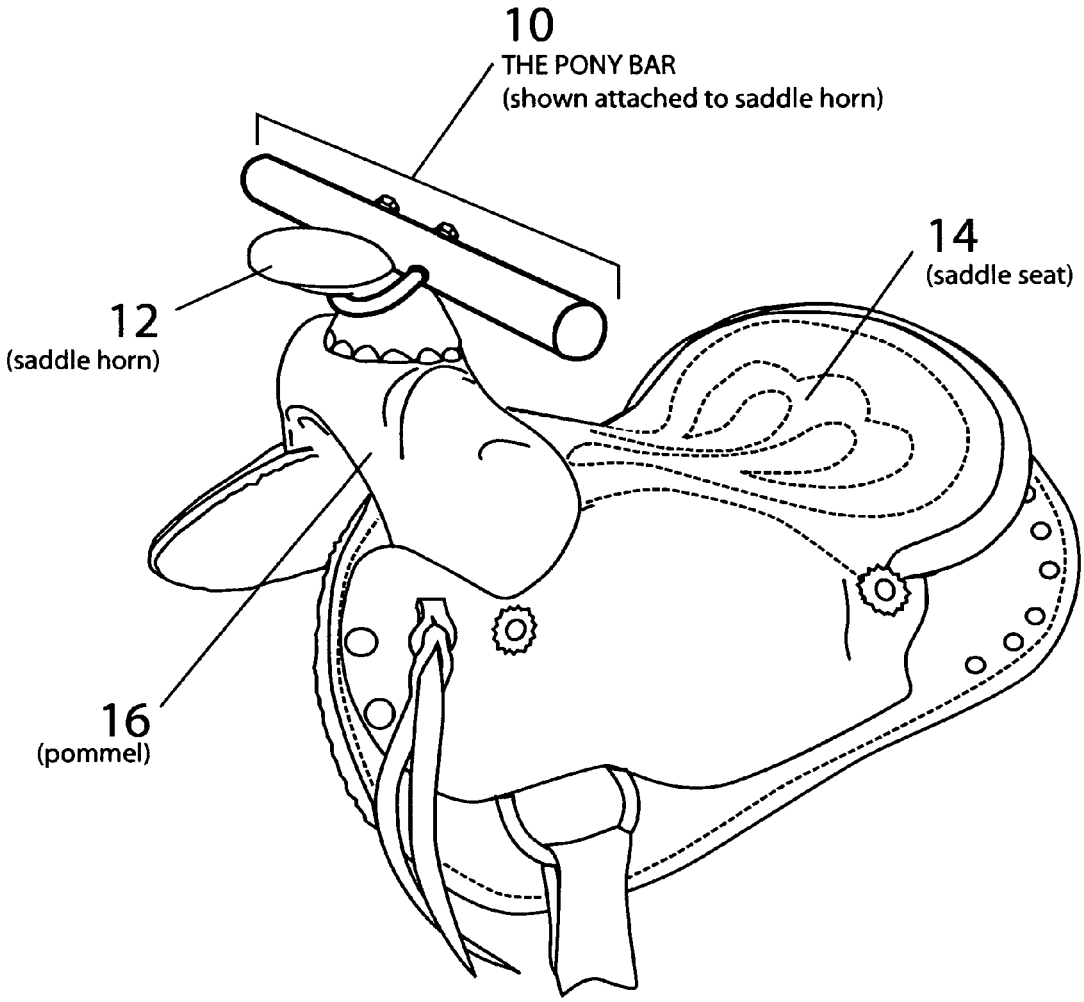
FIG. 1 shows The Pony Bar (10) attached to the horn of a western style saddle.
Figure 2:
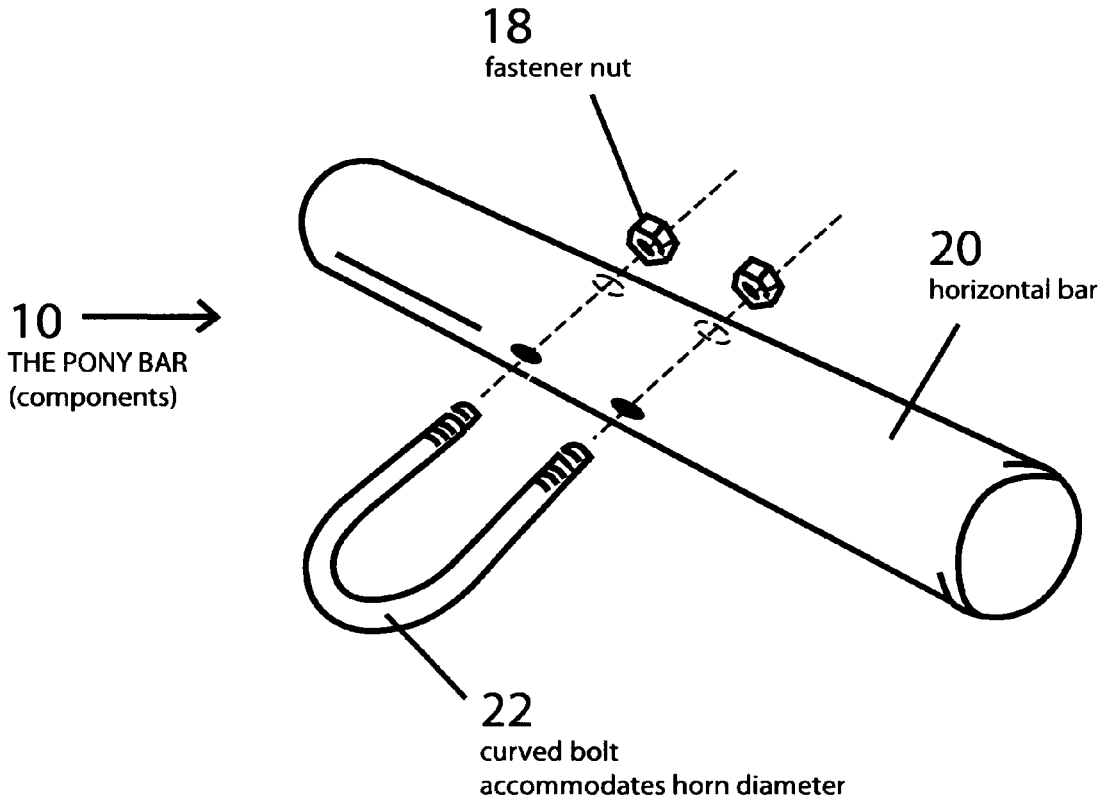
FIG. 2 shows The Pony Bar (10) alone in an exploded view comprised of its unassembled components.
Figure 3:
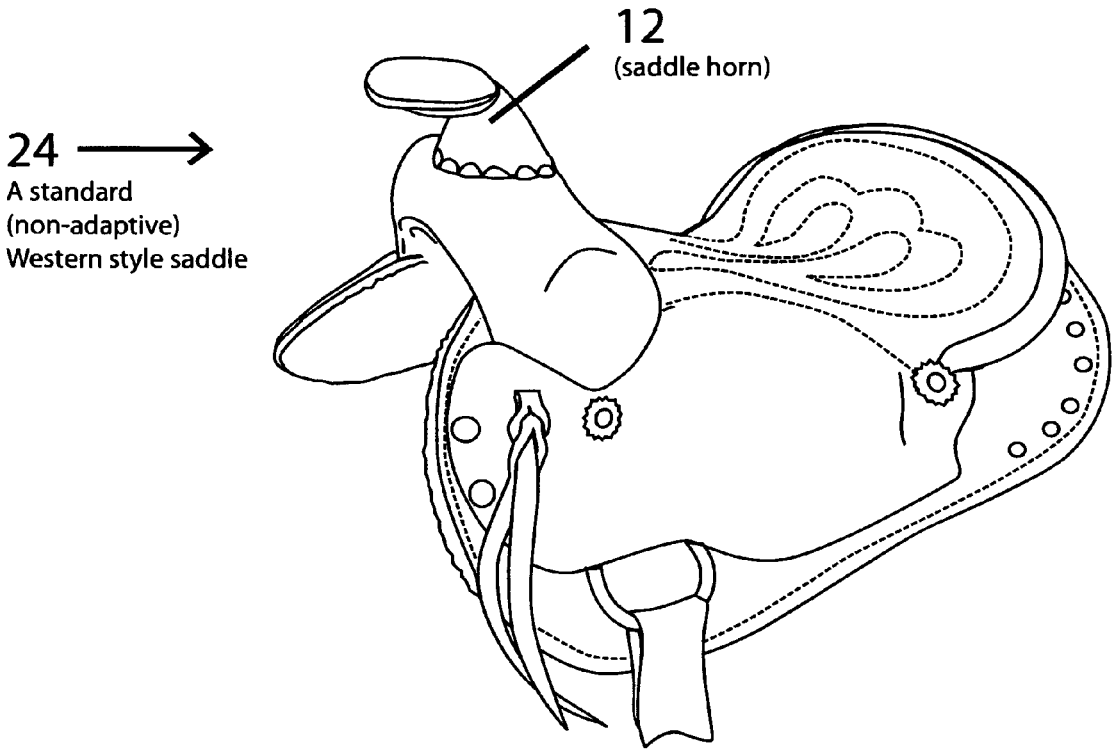
FIG. 3 (Prior Art)
FIGS. 3 and 4 show the important difference in basic structure between the two saddle types used to categorize the two overarching riding disciplines within the horse world—the Western style saddle and the English style saddle.
Figure 4:
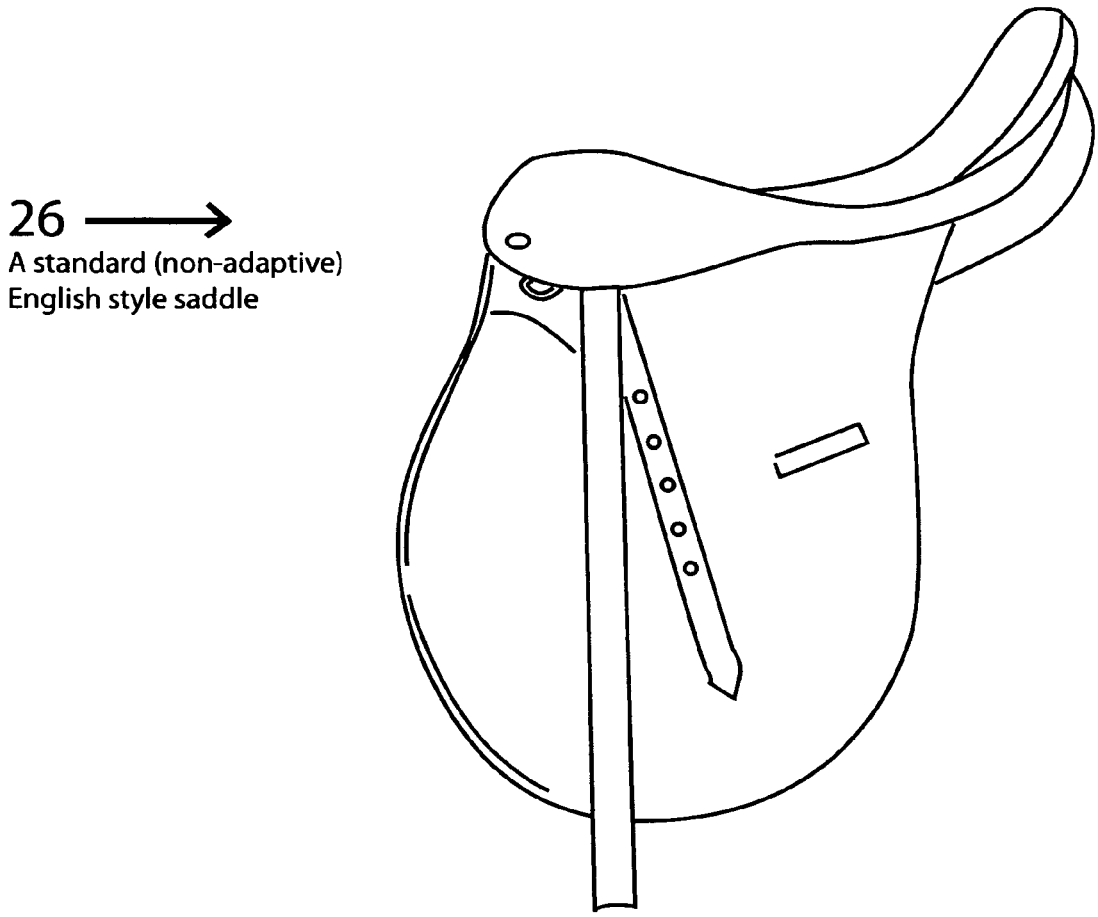
FIG. 4 (Prior Art)

Shown in FIG. 1, The Pony Bar (10) is a handle bar that securely attaches to the horn (12) of a horse riding saddle with a horn. Currently, there are two main disciplines of riding—English and Western as shown in FIG. 3, 4. Accordingly, there are two standard types of saddles being manufactured—English (26) and Western (24). The English saddle does not have a horn. The Western saddle does have a horn. The key to The Pony Bar invention is that it can be easily attached to a standard saddle horn without any modification to the basic factory manufactured saddle itself. There is no need to drill holes in the saddle, add attachment points, add support members or rebuild the saddle in any way. No damage or alteration is done to the saddle in order to attach The Pony Bar and yet this handle can withstand the torque and repeated rigors of everyday riding. It can be used as a permanent addition to any western saddle or it can be used as a removable device that when removed has not harmed the original integrity of the saddle structure nor caused any blemishes to the exterior of the saddle. This is quite important since saddles can be expensive and equestrians take pride in their saddles—they do not want to damage or modify a saddle unnecessarily.

The invention claimed is:

1. A handle bar attachment on a riding saddle comprising a seat portion (14), a horn (12), and the handle bar attachment being a horizontal handle (10) attached directly to and adjacent the upper end of the horn via a threaded bolt (22) and fastener nuts (18), with the longitudinal axis of the handle being orthogonal to the vertical axis of the horn and the length of the bar being greater than the width of the horn.

2. A handle bar attachment in accordance with claim 1 wherein the handle bar attachment is removable and does not require any modification to an existing manufactured saddle with a horn.

3. A handle bar attachment in accordance with claim 2 wherein the handle bar attachment is made of any stiff material including at least one of metal, wood or plastic and is grip coated with a protective material of rubber, fabric or plastic.

* * * * *